US008661575B2

(12) United States Patent
Chapus

(10) Patent No.: US 8,661,575 B2
(45) Date of Patent: Mar. 4, 2014

(54) SWIMMING POOL COVER AND ASSOCIATED OPENING AND CLOSING MECHANISM

(75) Inventor: Charles Chapus, Aurade (FR)
(73) Assignee: ABRISUD, L'Isle Jourdain (FR)

( * ) Notice: Subject to any disclaimer, the term of this patent is extended or adjusted under 35 U.S.C. 154(b) by 1274 days.

(21) Appl. No.: 10/596,039

(22) PCT Filed: Nov. 25, 2004

(86) PCT No.: PCT/FR2004/050619
§ 371 (c)(1),
(2), (4) Date: Mar. 27, 2008

(87) PCT Pub. No.: WO2005/052285
PCT Pub. Date: Jun. 9, 2005

(65) Prior Publication Data

US 2008/0263759 A1 Oct. 30, 2008

(30) Foreign Application Priority Data

Nov. 26, 2003 (FR) ..... 03 13869
Jul. 26, 2004 (FR) ..... 04 51658

(51) Int. Cl.
*E04H 4/00* (2006.01)

(52) U.S. Cl.
USPC ..... 4/500; 4/498; 52/66; 52/67

(58) Field of Classification Search
USPC ..... 4/498, 500, 503; 52/66, 67; 220/8, 602, 220/212
See application file for complete search history.

(56) References Cited

U.S. PATENT DOCUMENTS 3,415,260 A * 12/1968 Hall ..... 4/498
4,175,361 A * 11/1979 Kumode ..... 52/66
4,616,451 A * 10/1986 Glick ..... 52/66
4,783,861 A * 11/1988 Leurent ..... 4/498
5,778,603 A * 7/1998 Reppas ..... 52/66
6,637,160 B2 * 10/2003 Brooks ..... 52/66
2004/0187397 A1 * 9/2004 Chapus ..... 52/67

FOREIGN PATENT DOCUMENTS

FR 2 824 095 A 10/2002
FR 2 825 738 A 12/2002

OTHER PUBLICATIONS

International Search Report, Mar. 8, 2005, from International Phase of the instant application.
English Translation of the Written Opinion of the International Search Authority, Jun. 9, 2006, from International Phase of the instant application.
English Translation of International Preliminary Report on Patentability Chapter I, Jun. 10, 2006, from International Phase of the instant application.

* cited by examiner

*Primary Examiner* — Huyen Le
*Assistant Examiner* — Erin Deery
(74) *Attorney, Agent, or Firm* — Jackson Patent Law Office

(57) ABSTRACT

Disclosed is a pool opening to be exposed and/or concealed based on low profile covers constituted by roof components juxtaposed in the direction of the length of the swimming pool and each comprising a cover in a translucent material and a rigid frame formed of two arches placed in transverse planes and braced by longitudinal crosspieces with two end crosspieces delimiting two longitudinal parallel edges to the roof component and which rest on the longitudinal edges of the pool of said swimming pool defining a support surface, the system comprising a storage area located at an end of said pool said storage area being sufficient to accommodate the ground surface of a roof component allowing said roof components to be stored in a stacked way, all of said storage area being horizontally displaced from said pool opening, a wheel configured to mobilize said roof components allowing said roof components to be displaced horizontally along the pool towards and/or away from said storage area, a lifter in the storage area, the lifter being configured to engage said roof components to vertically displace said roof components said storage area, to position one roof component over another roof component in a stacked position.

24 Claims, 16 Drawing Sheets

600
800
840a
710a
710a
I
I
230a
230a
H

230a

V
H
710a
I

230a
I

SWIMMING POOL COVER AND ASSOCIATED OPENING AND CLOSING MECHANISM

TECHNICAL FIELD

The present invention has to do with building structures intended to cover, wholly or in part, a ground surface such as that delimited by a pool and relates more particularly to a provisional roof structure for a swimming pool constituted from a series of so-called roof components placed side-by-side so as to cover the pool longitudinally. In fact, the particular purpose of the invention is the different adaptations that allow a pool to be concealed and/or exposed rapidly and with the least possible amount of handling.

DESCRIPTION OF THE PRIOR ART

There are in the prior art several types of swimming pool covers, but the invention mostly applies to covers which, more commonly called "low profile covers", are composed of roof components placed juxtaposed over the length of the swimming pool and each performing a rotary movement on one of their longitudinal edges in order to part and thus give access to the water in the pool. In order to understand the invention more clearly, it is useful to state that the longitudinal, transverse and lateral positions of the roof components and/or of their constituent parts are considered relative to the longitudinal, lateral and transverse axes of the pool being considered in the context of the present invention as adopting a substantially rectangular configuration. These juxtaposed roof components are of the type of those which are each composed of a cover formed of panels of a translucent material such as polycarbonate with a double wall and a rigid frame, that is light and resistant to support the transparent cover, said frame being formed of arches placed in transverse planes and braced by crosspieces with two longitudinal end crosspieces delimiting two longitudinal edges to the roof component. These two longitudinal edges rest on the rims of the pool defining a support surface for said interlocked roof components, and are held there by means of fixing lugs which are anchored in a removable way in the surfaces supporting these components conventionally constituted by the longitudinal rims or copings of the pool.

In order to partially expose this swimming pool and to be able to use it in the open air, particularly in the spring as soon as the climate or the temperature allows it, the roof components of this swimming pool cover are often mounted to be individually half-openable so as to modulate the pool opening outwards. To this end, at least one of the longitudinal edges of the frame of the roof components is thus mounted articulated around the fixing lugs anchored in the support edges of the pool in a transverse angular plane of expansion, and the other edge is intended to receive two props the heads of which penetrate into each end of the edge and the feet are supported on the support edges of the pool so as to wedge said props between the edges of the pool and said roof component which is thus held inclined relative to the ground, in the half-open position required. This device for holding a roof component in respect of low profile covers in a half-open position has constraints in that:

- it restricts the exposure of the swimming pool to said half-open position,
- it requires, for its handling, the use of two props as lever arms for each of the roof components,
- it often needs two people to be involved in order to lift each roof component,

- it offers the half-open roof components a significant wind catch which tends to destabilise them,
- it takes a relatively long time to install and, or uninstall for several roof components,
- etc.

Many improvements have been made over recent years in order to simplify the operation of lifting the roof components by using a prop mounted to slide in the edge in order to act as a lever by exerting an upward force on the middle of the edge, or by using different lifting systems to minimise effort.

Despite these different innovations allowing the transfer of the roof components from a closed position to a half-open position to be substantially improved by sparing the user as far as possible the efforts to be exerted during this operation, the applicant has noted that opening the roof components constituting the swimming pool roof still remained a difficult handling operation, although simplified by the very fact of the weight of said roof components. This handling even becomes a real difficulty when the swimming pool and therefore the roof components covering it are of large dimensions or it is necessary to raise a number of them.

Moreover, in the summer period of so-called full use of the pool, fully exposing the pool covered by such so-called low profile cover roof components requires them to be removed manually one by one so that they can be conveyed to a storage area situated away from the pool and often even far away from it for reasons of aesthetics and clutter. Conversely in the winter period of so-called non-use in order to cover the pool back up again, these same roof components will be conveyed from their storage area to the pool which they will cover in such a way as to seal the opening thereof. These laying and/or removal operations constitute by no means inconsiderable handling problems which require the intervention of at least two people, the provision of a relatively substantial storage area not to mention the considerable physical effort that has to be exerted to displace roof components of this kind.

BRIEF DESCRIPTION OF THE INVENTION

Starting from this state of affairs, the applicant has conducted research which has led to a new swimming pool roof concept that reconciles the advantages of low profile covers preferably with juxtaposed and articulated roof components with those of high profile covers with telescopic roof components.

To this end, the invention proposes the implementation of a device which, since it allows a pool opening to be exposed and/or concealed automatically and easily based on low profile covers constituted by juxtaposed and articulated roof components of the type described above, includes:

- storage means located at one end of said pool and allowing said roof components to be stored in a stacked way,
- means of mobilising said roof components that allow them to be displaced horizontally along the pool towards and/or away from said storage means,
- stowing means allowing the aforementioned roof components disengaged from the pool to be placed in the aforementioned storage means and in a stacked position,
- and means of connecting said roof components to each other, indissociable on the one hand so as to secure them to each other in order to form a roof component train able to be displaced integrally and horizontally along said pool, and dissociable one from another on the other hand, to allow the vertical displacement of said roof components for the purpose of stacking them in the aforementioned storage means.

When the aforementioned roof components are of the type such that at least one of its longitudinal edges is mounted articulated relative to the support edge of the pool, an articulation relative to which it swivels in order to transfer from a closed position to a half-open position and vice versa, the device of the invention offers a great advantage by giving the dual possibility of exposing the pool either on one side or other of the longitudinal plane of the pool by tilting the roof components and on one side or other of the transverse plane of the swimming pool by the displacement of a roof component train which are stacked in the storage means which, located at one end of the pool, present themselves, according to one preferential embodiment of the invention, in the form of a storage area corresponding to at least the ground surface of one roof component and to which said roof components will be admitted.

Additionally, the fact of associating several roof components one behind the other and of making them mobile along the pool in the form of a train by means of running gear provided on the two longitudinal parallel edges of each roofing element which will slide by running on the longitudinal edges of the pool, allows, by associating with them at least one motor-drive roller which, when judiciously placed at the input of the aforementioned storage means and being supported on the aforementioned roof component train, will be able to make them run automatically in a direction outwards from the pool in the direction of the storage area of said storage means in order to expose the pool which they were covering and to store them in the storage area in a stacked way and, in the other direction, inwards to the pool so as to discharge them from the storage area and to make them run in the form of a train of juxtaposed roof components to conceal the pool opening.

Thus, each roof component entering the storage means will then be lifted vertically at the same time as the others so that it can be stacked with the stack being fed from underneath.

Although the fundamental concepts of the invention have been mentioned above in their most elementary form, other details and characteristics of the invention will emerge more clearly from reading the following description which gives as a non-restrictive example and with reference to the appended drawings, an embodiment of a swimming pool roof fitted with a device in accordance with the invention that allows this pool opening to be exposed and/or concealed based on low profile covers constituted by juxtaposed roof components.

DESCRIPTION BASED ON THE DRAWINGS

Figure 1:
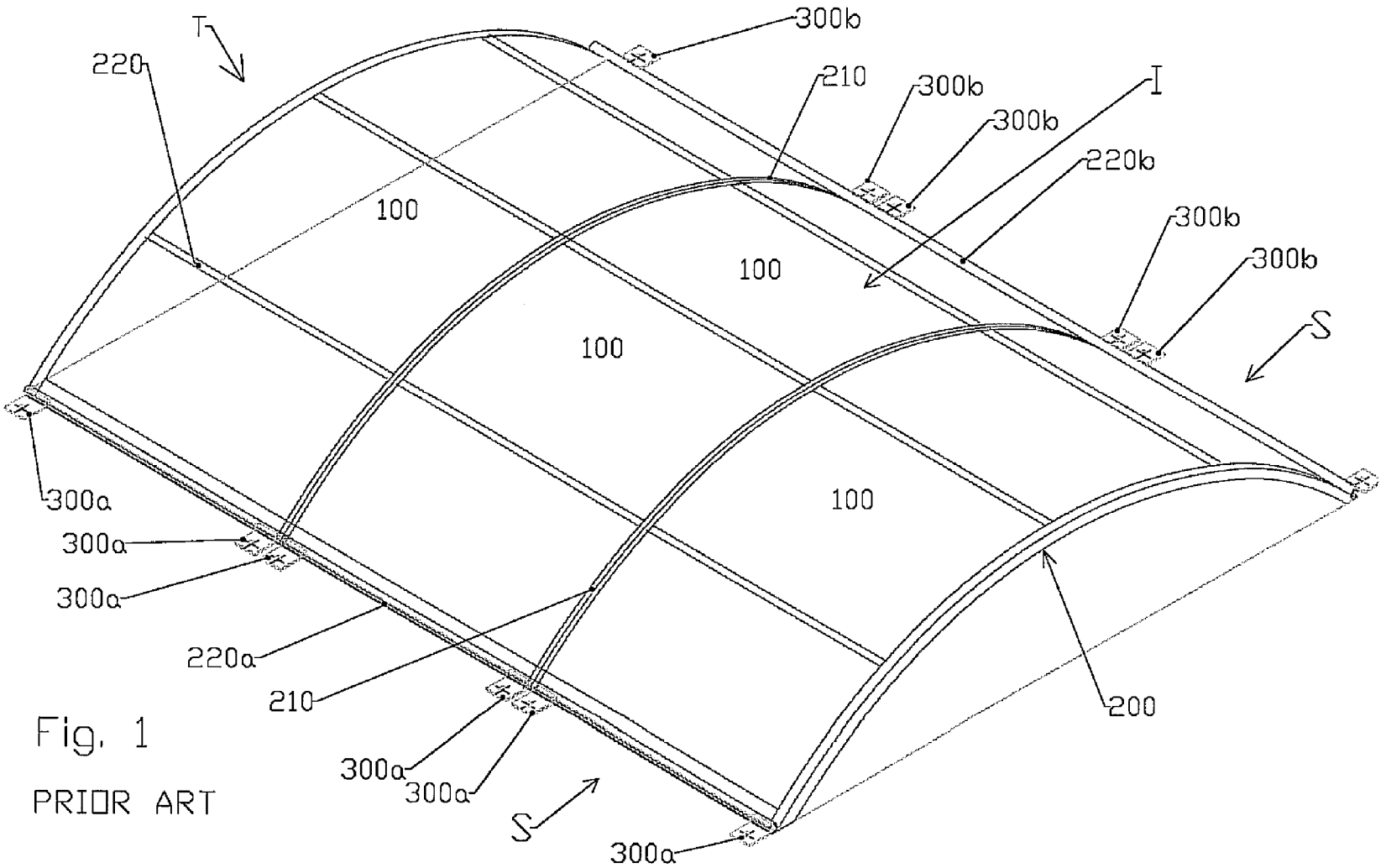
Fig. 1 PRIOR ART
FIG. 1 is an isometric perspective view of a swimming pool roof in respect of low profile covers of conventional design and shown in the closed position.

The drawing in FIG. 1 shows a prior art swimming pool roof more commonly called a low profile cover and shown in the closed position. This roof, given the reference T throughout, is conventionally constituted by a series of three roof components I of the type wherein they are each composed of a cover formed of panels in a translucent material 100 such as polycarbonate with a double wall and with a rigid light and resistant frame 200 in the form of arches 210 placed in transverse planes and braced by crosspieces 220 so as to support said cover. The two end cross-pieces 220 of the frame delimit two parallel longitudinal edges 220*a* and 220*b* to the roof components I which are held on the longitudinal edges S of the pool defining a support surface, by means of fixing lugs given the references 300*a* and 300*b* respectively and being anchored in a removable way in said edges S or in the copings capping said edges.

Figure 2:
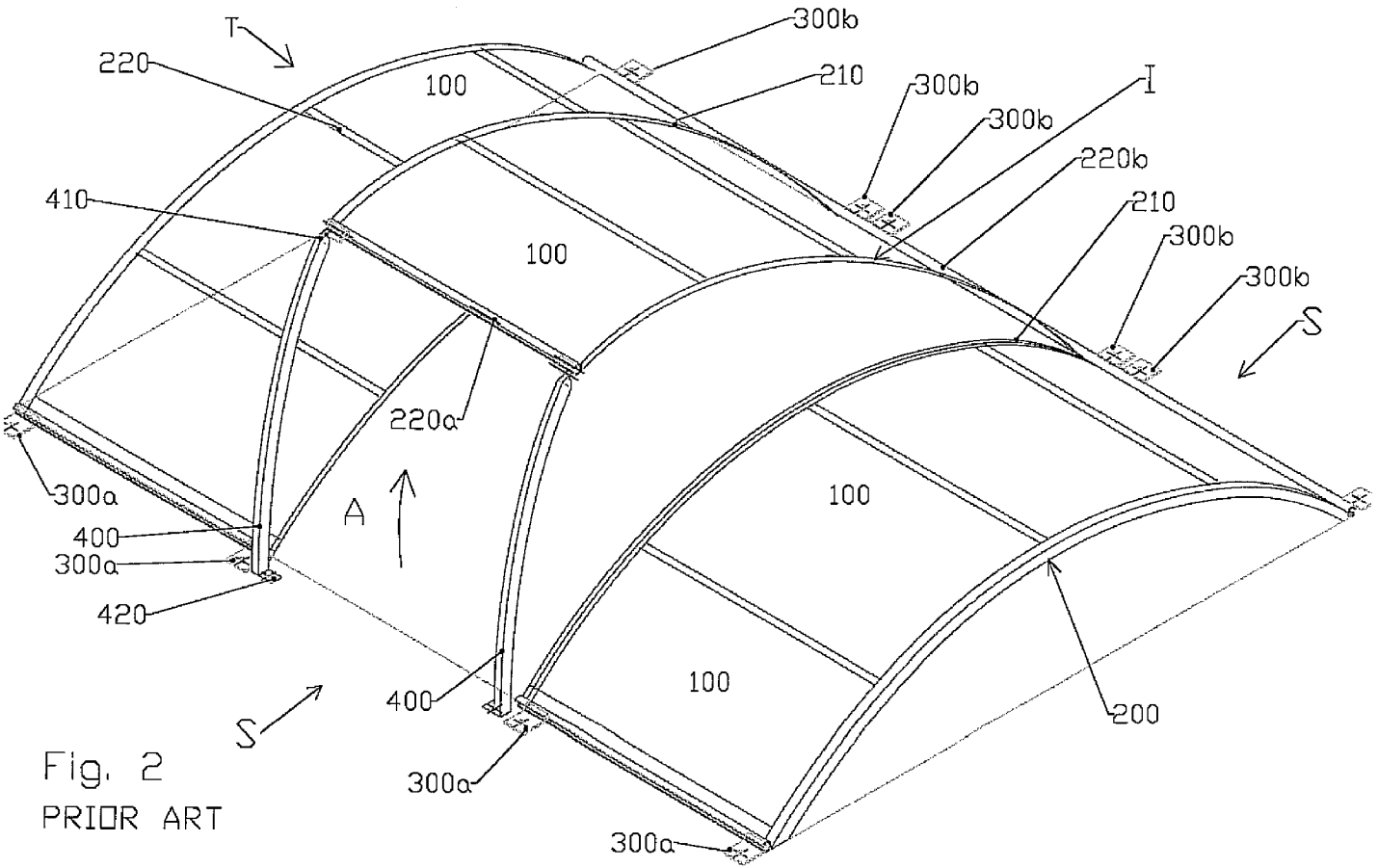
Fig. 2 PRIOR ART
FIG. 2 is an isometric perspective view of the swimming pool roof in the drawing in FIG. 1, shown in the partially half-open position.
Figure 3:
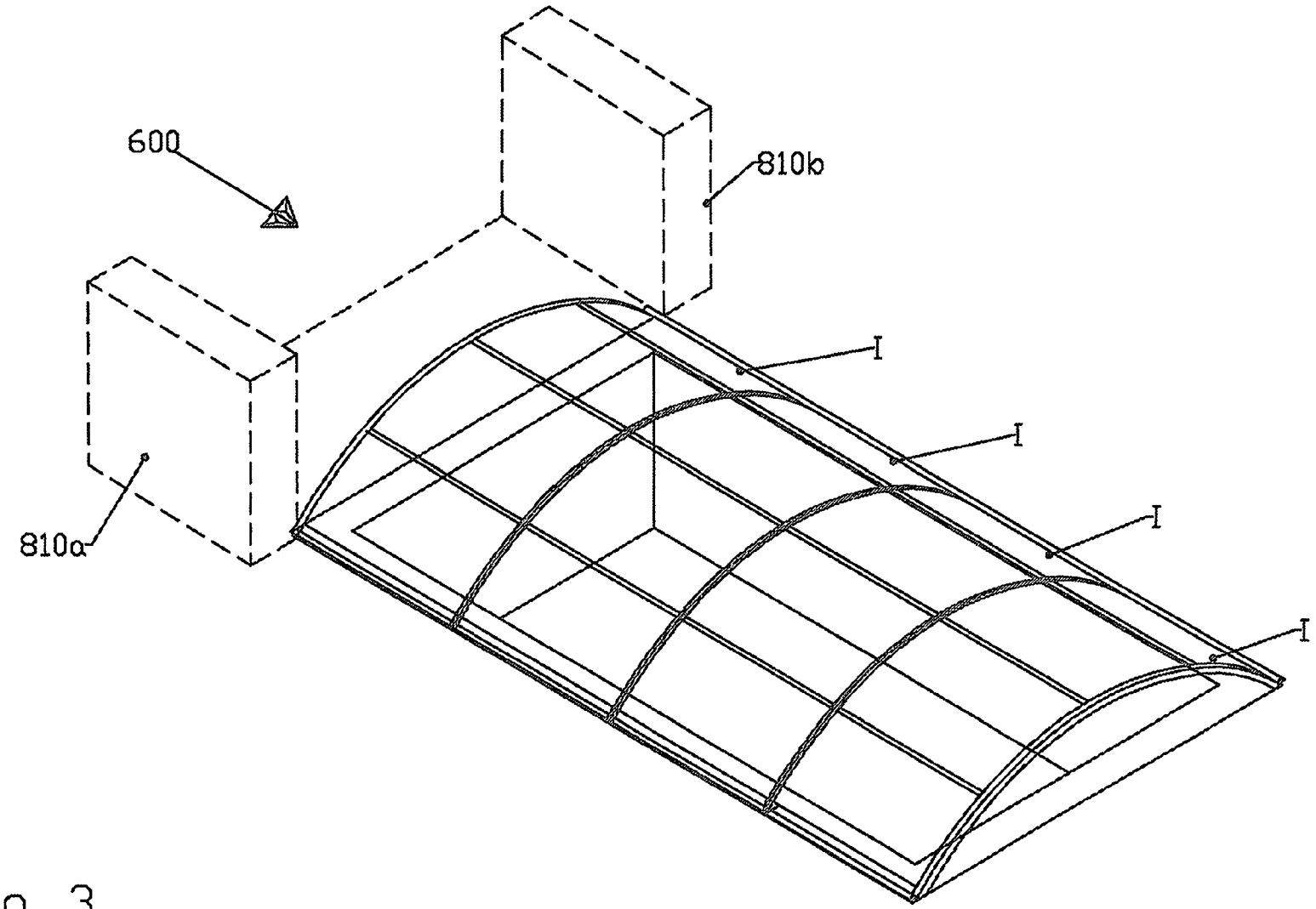
FIG. 3 is an isometric perspective view of a swimming pool roof according to the concept of the invention and shown in the closed position.
Figure 4:
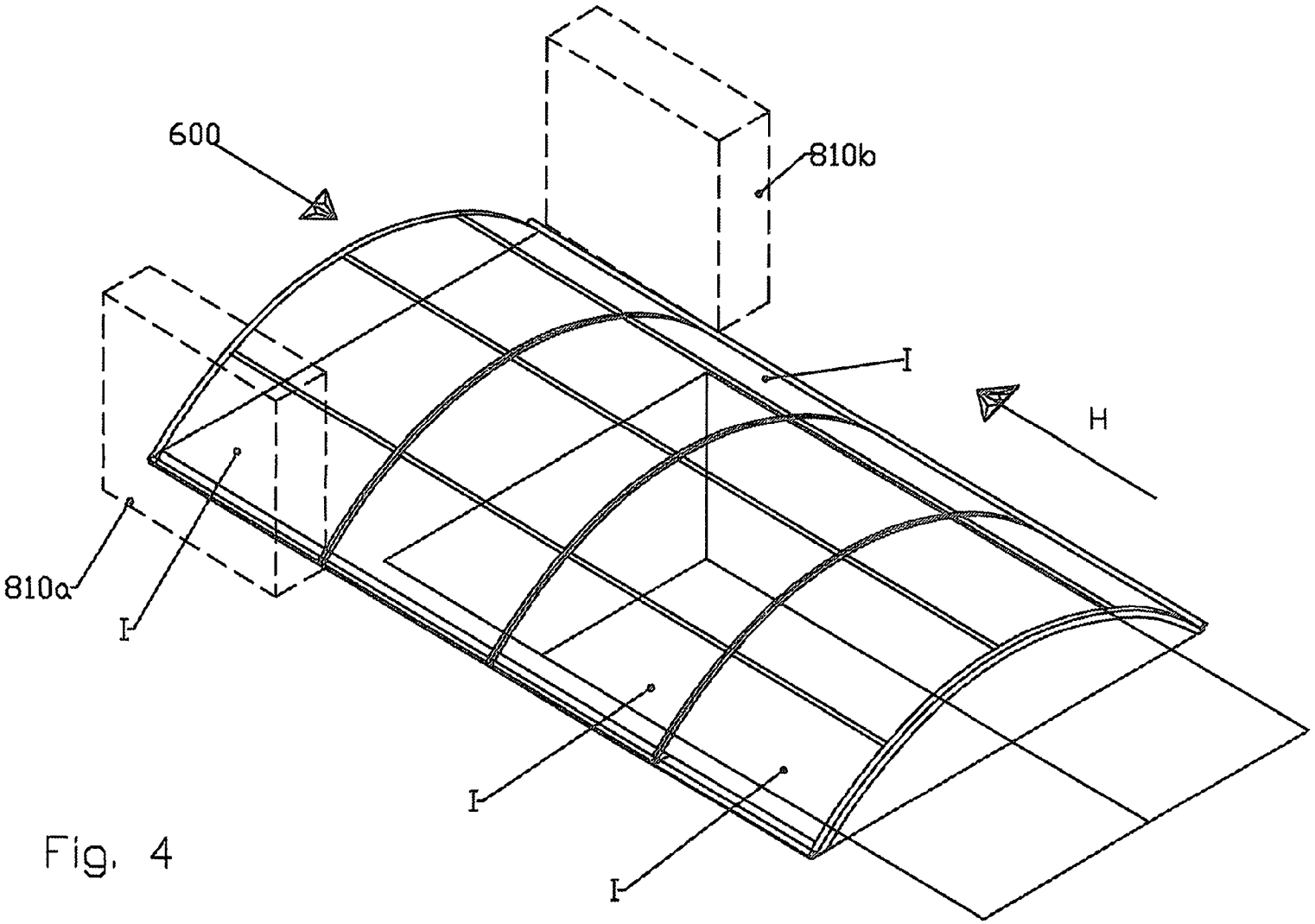
FIGS. 4, 5 and 6 are isometric perspective views of the swimming pool roof of the drawing in FIG. 3, in three positions of progressive exposure of the pool.

As can be seen in the drawing in FIG. 2, one (the central one) of the roof components I is shown in the half-open position thus allowing the pool to be partially exposed. To this end, one (220*a*) of the two longitudinal edges of the frame of this roof component is released from its fixing lugs 300*a* thus allowing said roof component I a tilting movement on its second edge 220*b* around the two fixing lugs 300*b*, according to an angular expansion (symbolised by the arrow A) in a plane transverse to the pool. The roof component I is held in this half-open position by means of two struts formed by props 400 the heads 410 of which enter each end of the edge 220*a* and the feet 420 of which are supported on the longitudinal edges S of the pool in which they are anchored in place and instead of the fixing lugs 300*a* which have just been released.

The drawings in FIGS. 3, 4, 5 and 6 show a new swimming pool roof concept with now four (this number of four is given only as an illustrative example and to clarify the drawings) roof components I of the low profile cover type articulated like those shown in the drawings in FIGS. 1 and 2 but fitted with the device of the invention allowing the pool opening to be exposed and/or concealed without any handling operation of installation, removing or transporting said roof components I.

To this end, the device of the invention includes a set of means which, when judiciously combined together, are responsible in an autonomous way for displacing and stowing the roof components I allowing the pool opening to be exposed (cf. FIG. 6) and/or concealed (cf. FIG. 3), without any manual intervention.

Figure 5:
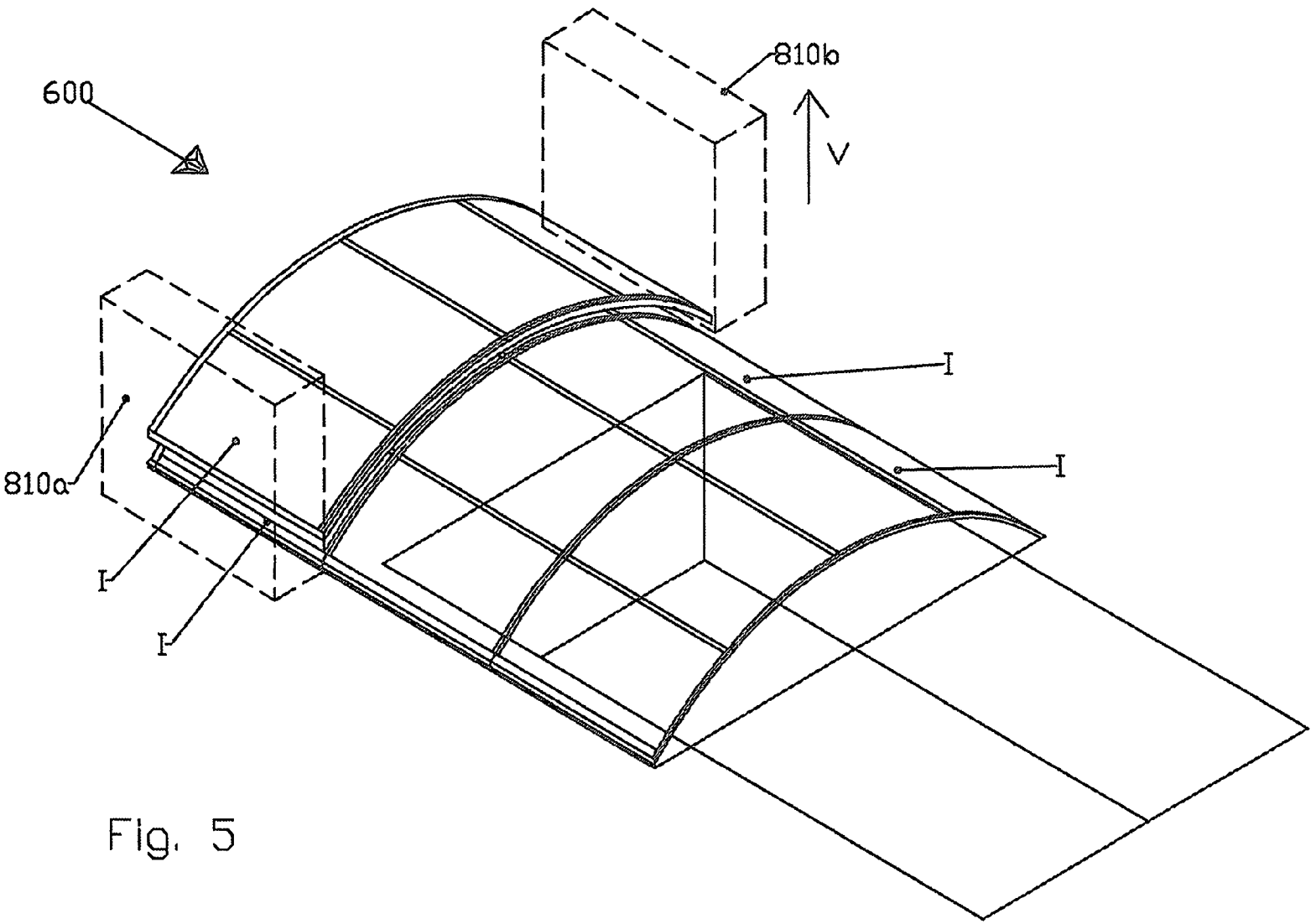
Figure 6:
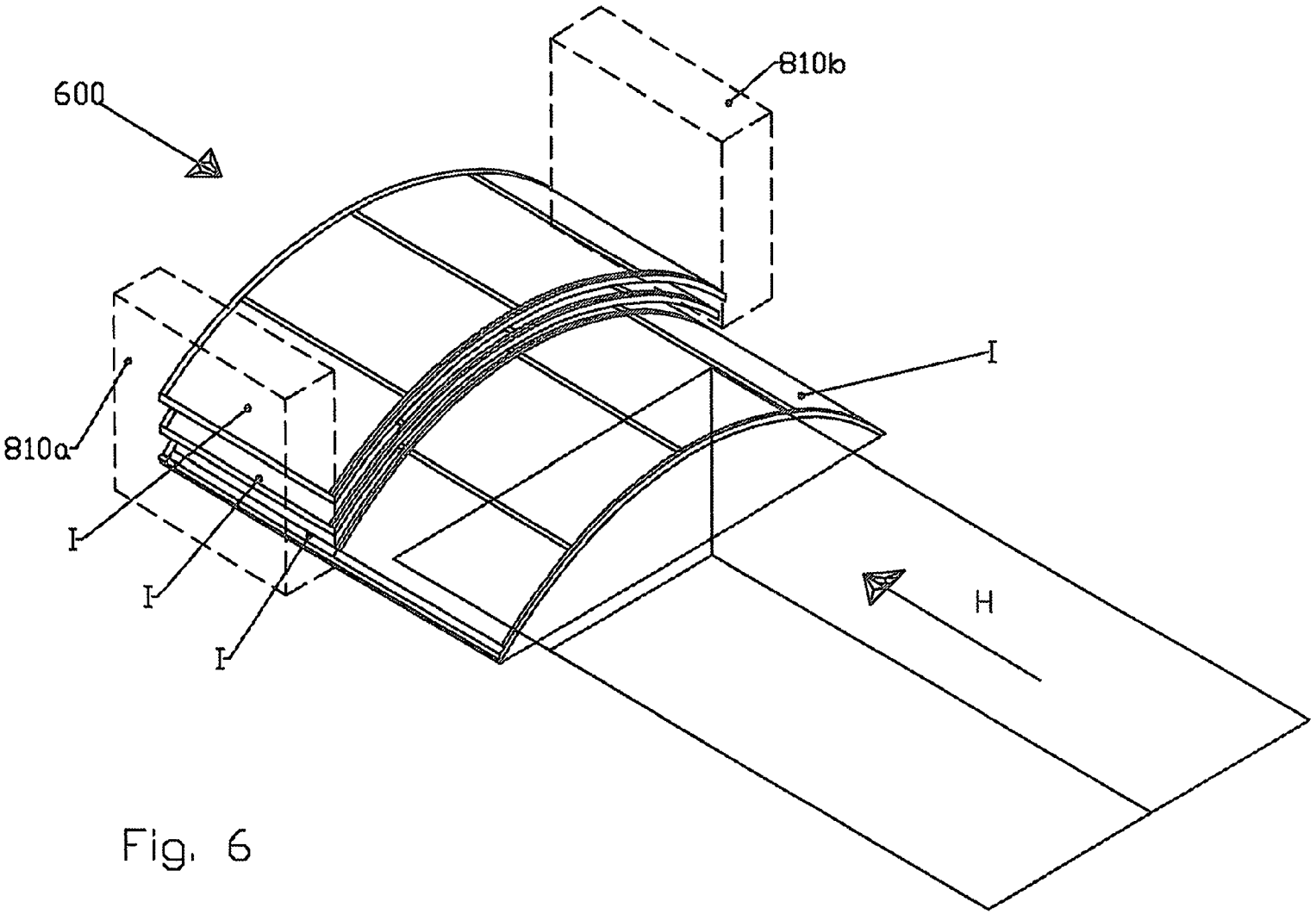

The first so-called storage means 600 are located at one end of said pool and are used to store the roof components I in a stacked way, as shown in the drawings in FIGS. 5 and 6. These storage means 600 are presented to this end in the form of a storage area of a size such that said roof components I can be admitted to it.

Figure 7:
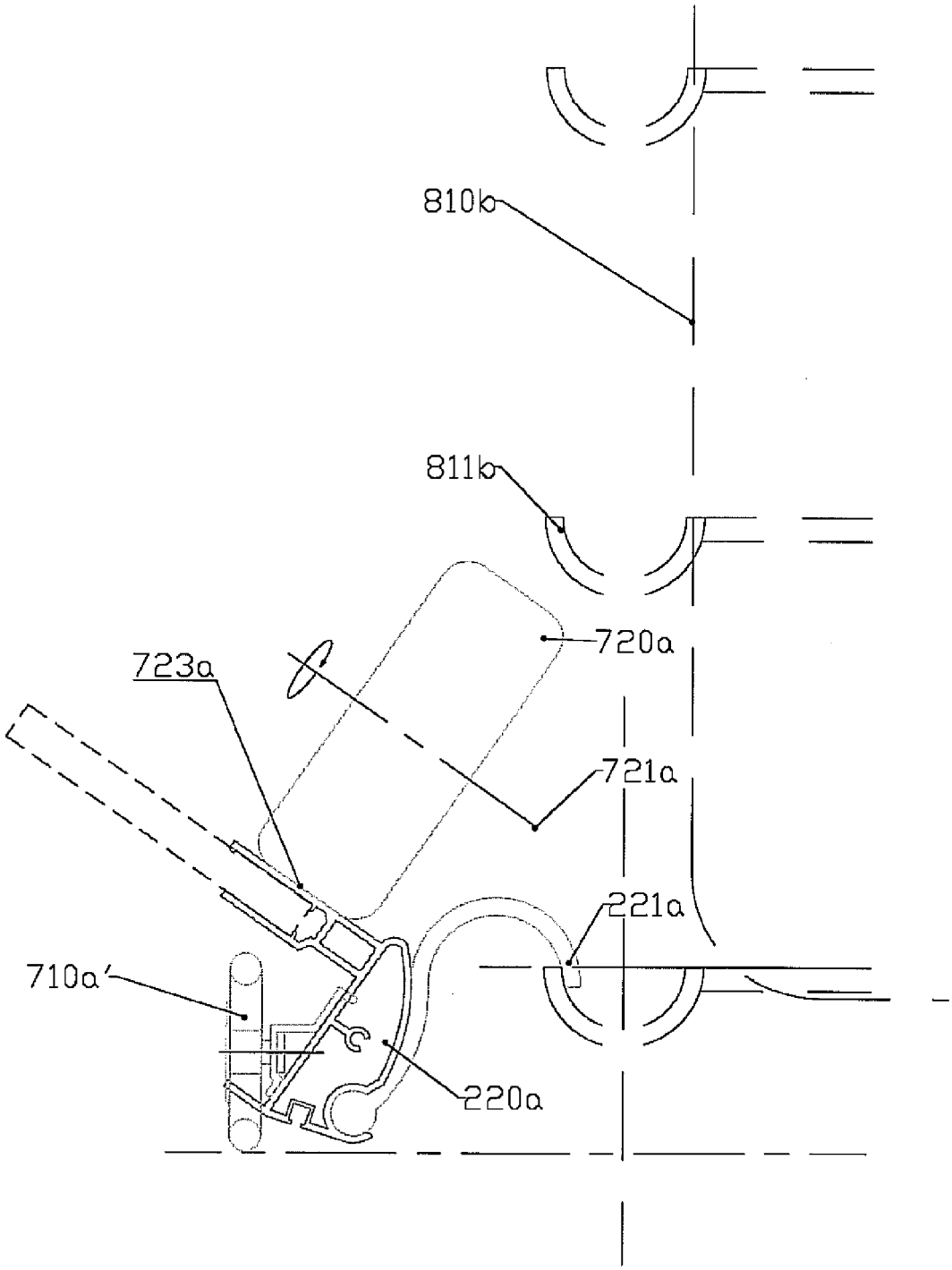
FIG. 7 is a vertical partial cross-section view of a swimming pool roof component showing one of the two longitudinal edges fitted with a component of the device of the invention.

The second so-called mobility means allow a said roof components I to be displaced horizontally along the pool towards (arrow H) and/or away from (reverse direction of the arrow H) the storage means 600. These mobility means are presented to this end in the form:

on the one hand, of running gear 710*a* (shown in more detail in the drawing in FIG. 7) and which, distributed over the width of the two parallel longitudinal edges 220*a* and 220*b* of each roof component I, ensure the free displacement (arrow H) of the edges 220*a* and 220*b* along the edge S, and therefore of the whole of the roof component I associated with it, and on the other hand, by at least one 720*a* (as shown in the drawing in FIG. 7) but preferably two motor-drive rollers which, placed at the input of said storage means 600, are supported on the roof component I present in front of them so as to make it run either in the direction of the arrow H to make it completely enter (cf. FIG. 4) the storage area of the storage means 600 so as to disengage it from the pool which it was covering and to store it in the storage area 600 in a stacked way or, in the other reverse direction to that of the arrow H, inwards towards the pool, so as to discharge it from the storage area 600 by pushing the other roof components I which, in the form of a train of juxtaposed roof components will gradually cover the pool opening.

Thus, the two longitudinal edges 220*a* and 220*b* of the roof components I rest of the edge of the pool S via the running gear 710*a* allowing, once the fixing lugs 300*a* and 300*b* have been released from their anchoring in the aforementioned support edge S, the roof components I (arrow H) to be freely displaced towards the storage area 600 of the storage means. This evolution (arrow H) of the roof components I from an intermediate position shown in FIG. 4 to a more advanced position shown in FIG. 6, allows the pool to be gradually exposed at one of its ends. Although not shown, it should be noted that the roof component train I will be displaced (arrow H) along the support edge S but outwards from the pool fully stacked in the storage area 600, so as to fully expose the pool.

Conversely, by displacing the roof component train I in the reverse direction from that of the arrow H along the support edge S but inwards towards the pool, the roof component train I will gradually re-cover and seal the pool.

According to one particular adaptation of the invention, the two motor-drive rollers (only one of which 720*a* is shown in the drawing in FIG. 7) ensuring the horizontal displacements (arrow H) of the roof components, have their axes of rotation 721*a* placed substantially inclined relative to the vertical and inwards towards the pool in such a way that the treads 723*a* of said motor rollers are supported on the longitudinal edges 220*a* and 220*b* of the roof components I while guiding said roof components I in the storage area 600.

According to another particularly advantageous characteristic of the invention showed in FIGS. 12, 13*a*, 13*b*, 13*c*, 13*d*, the mobility means are presented in the form:

on the one hand, of said running gear 710*a* and which, distributed over the width of the two parallel longitudinal edges 220*a* and 220*b* of each roof component I, ensure the free displacement (arrow H) of the edges 220*a* and 220*b* along the edge S, and therefore of the whole of the roof component I associated with it, and on the other hand, by at least one translation mobilisation means 730*a* of the pinion 731*a*/rack 732*a* type. The pinion 731*a* is drawn into rotation by a fixed geared motor unit and the rack 732*a* is as shown integral with the longitudinal edge of the roof component. According to the embodiment shown, the rack 732*a* is integrated with the lateral edges. These pinions, of which only 731*a* is shown, are placed at the input of said storage means 600. They become enmeshed with the racks integral with the roof component I present in front of them so as to make it run according to their direction of rotation either in the direction of the arrow H in order to make it completely enter (cf. FIG. 4) the storage area 600 in order to disengage it from the pool which it was covering and to store it in the storage area 600 a stacked way or, in the other direction reverse to that of the arrow H, inwards towards the pool so as to discharge it from the storage area 600 by pushing the other roof components I which, in the form of a train of juxtaposed roof components, will gradually cover the pool opening.

According to one particularly advantageous characteristic, the storage means 600 are to advantage fitted with components that not only act as a mechanical stop unit 610 for the roof components I in their translatory motion towards the storage area 600 but also act as a guide during their translation from top to bottom and from bottom to top during the elevation or descent phase. This characteristic ensures the longitudinal positioning of the roof components when they are in the storage area 600.

Figures 14A, 14B, 14C:
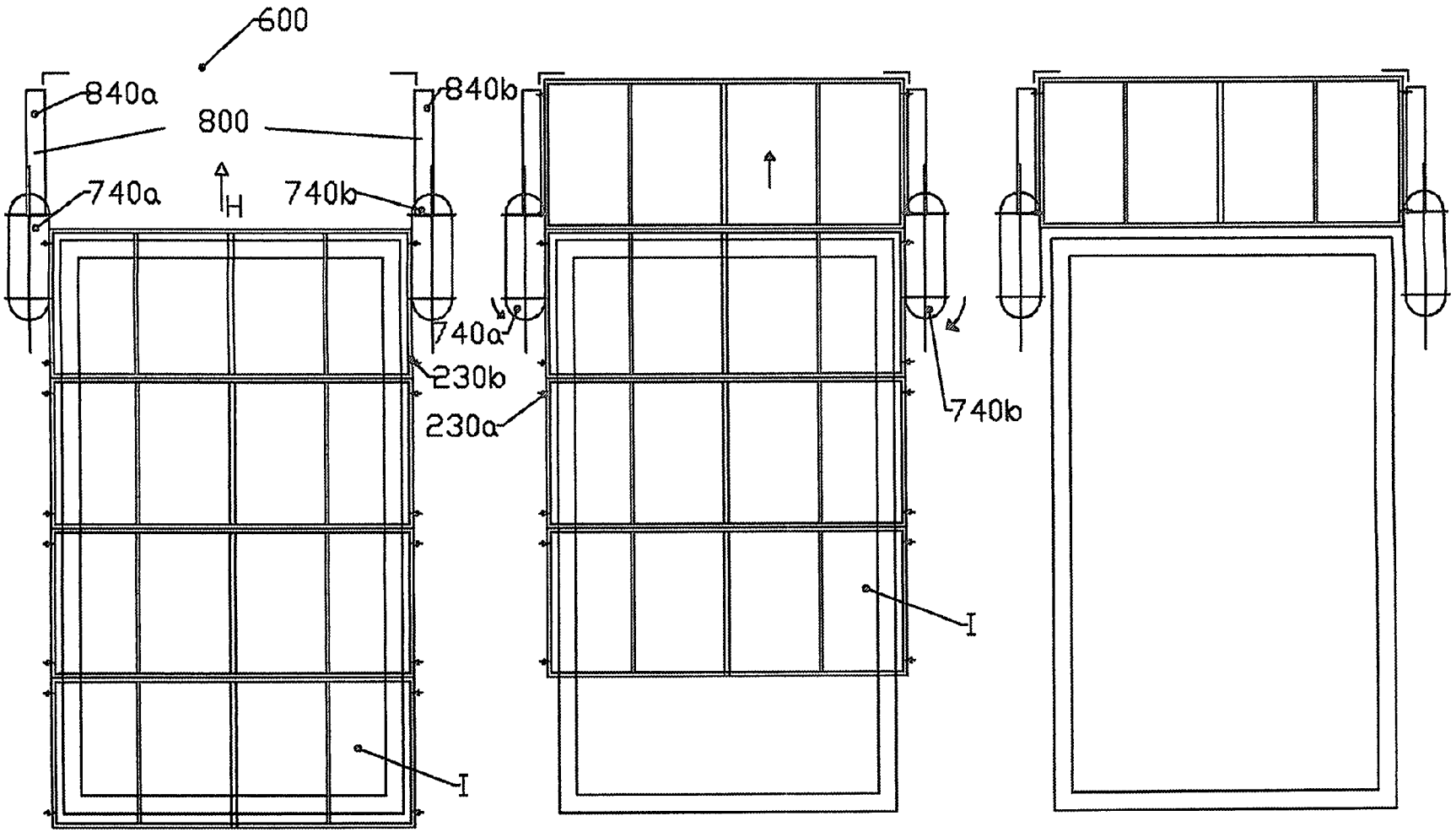
FIGS. 14*a*, 14*b*, 14*c* are diagrammatic drawings of a view from above of an embodiment of a device in accordance with the invention showing another mobility means and stowing means solution.

According to another particularly advantageous characteristic of the invention shown in FIGS. 14*a*, 14*b* and 14*c*, the mobility means are presented to this end in the form:

on the one hand, of said running gear 710*a* (shown in more detail in the drawing in FIG. 7) and which, distributed over the width of the two parallel longitudinal edges 220*a* and 220*b* of each roof component I, ensure the free displacement (arrow H) of the edges 220*a* and 220*b* along the edge S, and therefore of the whole of the roof component I associated with it, and on the other hand, by at least one but preferably two horizontal motor endless strips 740*a* and 740*b*, which, placed at the input of the aforementioned storage means 600, engage with the roof component I present in front of them so as to make it run either in the direction of the arrow H to make it completely enter the storage area of the storage means 600 so as to disengage it from the pool which it was covering and to store it in the storage area 600 in a stacked way or, in the other direction reverse to that of the arrow H, inwards towards the pool so as to discharge it from the storage area 600 by pushing the other roof components I which, in the form of a train of juxtaposed roof components, will gradually cover the pool opening.

According to a preferred embodiment, the engagement between the horizontal motor strips and the roof components is made by means of pins 230*a* and 230*b* integral with the roof components and which grip the endless horizontal motor strips 740*a* and 740*b* which are equipped with fastening means provided to this end.

Figure 8:
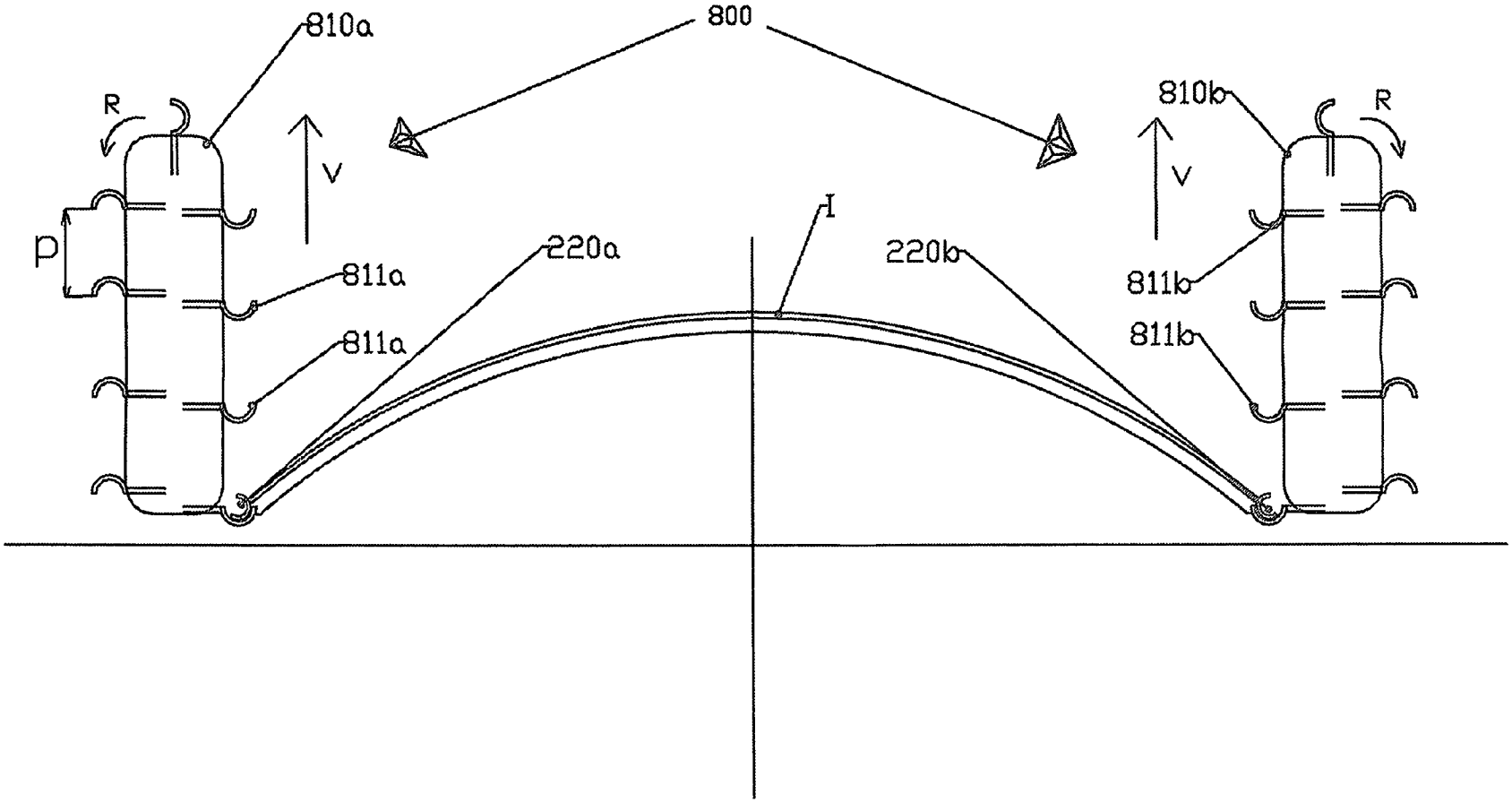
FIG. 8 is a diagrammatic view in vertical cross-section at the end of the swimming pool roof as shown in the drawing in FIG. 4 and shows a first embodiment of the stowing means.
Figure 9:
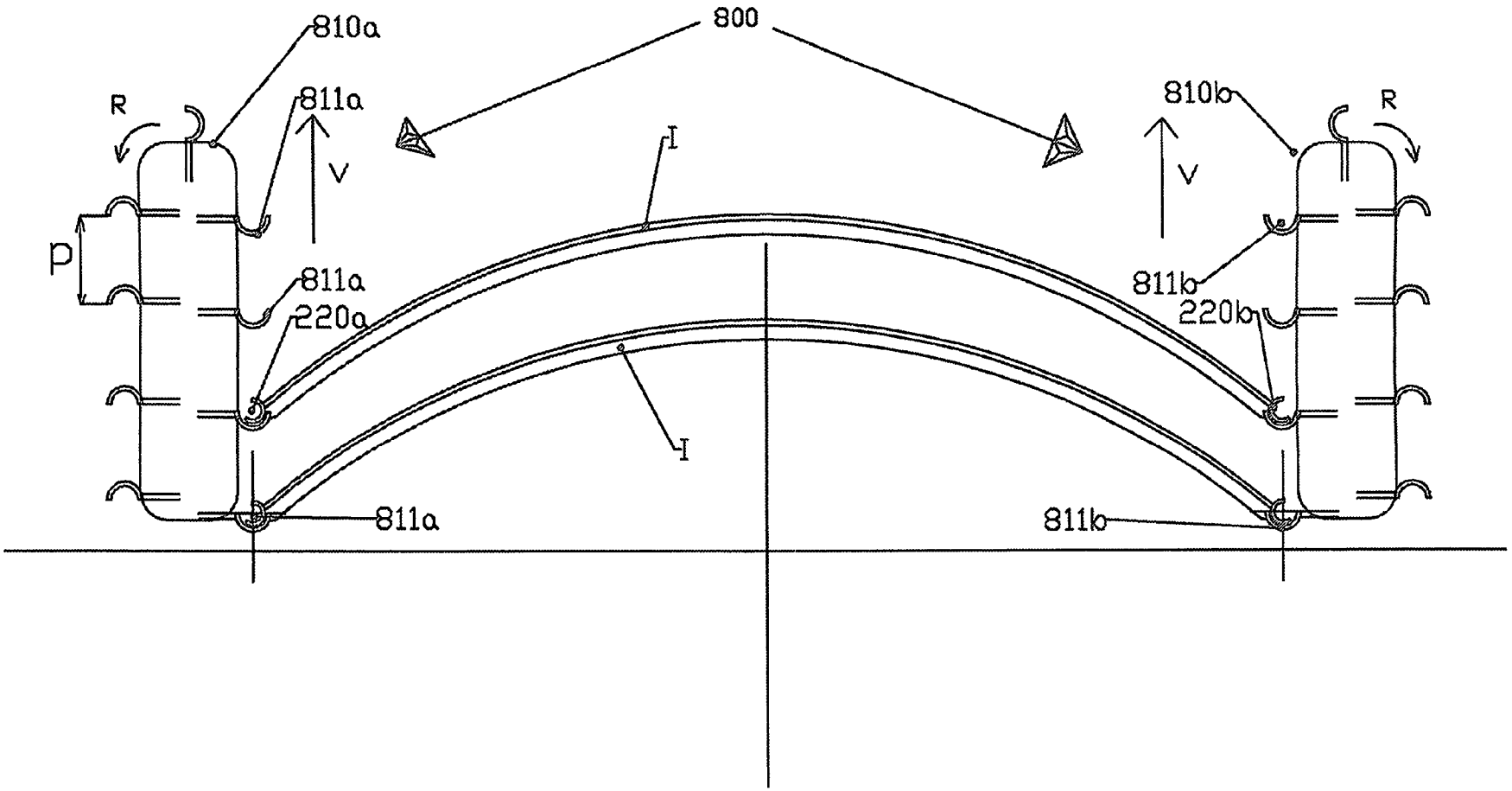
FIG. 9 is a diagrammatic view in vertical cross-section at the end of the swimming pool roof as shown in the drawing in FIG. 5 with the same embodiment of the stowing means as that shown in FIG. 8.

The function of the third means 800 (shown in FIGS. 8 and 9) the so-called stowing means is to stow the roof components I in the storage area 600 and in a stacked position, under the effect of the horizontal displacement (arrow H) of the roof components I by the motor-drive rollers 720*a*.

According to one particularly advantageous characteristic of the invention as shown in FIGS. 8, 9 and 11*a*, 11*b*, 11*c*, these stowing means 800 are, to this end, constituted by a support frame acting as a framework for at least two conveyors 810*a* and 810*b* which, placed in the storage area 600 on either side of the stack of stacked up roof components I, are able to grip and vertically displace (arrow V), in the storage area 600, each roof component I in an upward movement so as to store them stacked one on top of the other but by feeding them one underneath the other and in a downward movement (reverse to that of the arrow V) so as to lay them on the longitudinal edges of the pool in order to juxtapose them one next to the other. These two conveyors 810*a* and 810*b* are each constituted by an endless strip drawn in rotation (arrows R) around two return cylinders not shown in the upper and lower part of the conveyors 810*a* and 810*b* and one of which is a drive cylinder to drive the endless strip around said cylinders.

According to a first embodiment and in accordance with the invention, the two endless strips 810*a* and 810*b* are provided over their widths with at least one chain of gripping mechanisms 811*a* and 811*b* placed opposite each other for each endless strip 810*a* and 810*b* so as to engage simultaneously (as can be seen in the drawing in FIGS. 8 and 9) with the two longitudinal parallel edges 220*a* and 220*b* of each roof component I which is presented between them in the storage area 600. These gripping mechanisms 811*a* and 811*b* are, according to an embodiment of the invention shown in more detail in the drawing in FIG. 7, embodied in hooks which are, on the one hand, evenly spaced out by a pitch "p" one from the other, and, on the other hand, adapted so as to engage with corresponding fastening means 221*a* (for example hooks turned downwards) on the longitudinal parallel edges 220*a* and 220*b* of the roof components I through the rotation (arrow R) of the endless strips 810*a* and 810*b* which ensure a linear vertical displacement (arrow V) of the hooks 811*a* and 811*b* associated with it over the rectilinear portion of said strips. Thus, by activating with a pitch "p" the pitch-by-pitch displacement of the endless strips 810*a* and 810*b* in the direction of the arrow V and corresponding to the spacing pitch "p" of two hooks 811*a* or 811*b* on one and the same chain, these are engaged at the beginning of the displacement pitch with the lateral edges 220*a* and 220*b* of the roof component I, equipped to this effect with said appropriate means fastening to the hooks 811*a* and 811*b*, so as to lift them subsequently above the storage area 600 by a pitch "p", in such a way that said roof component I and the previous ones which have been hooked in the same way by the previous hooks are stored in a stacked away in the storage area 600 as they are admitted to it. The pitch-by-pitch movement reverse to that of the arrow R of the endless strips 810*a* and 810*b* will provide the descent (reverse direction to that of the arrow V) for the purpose of discharging the roof components I from the storage area 600.

Figures 11A, 11B, 11C:
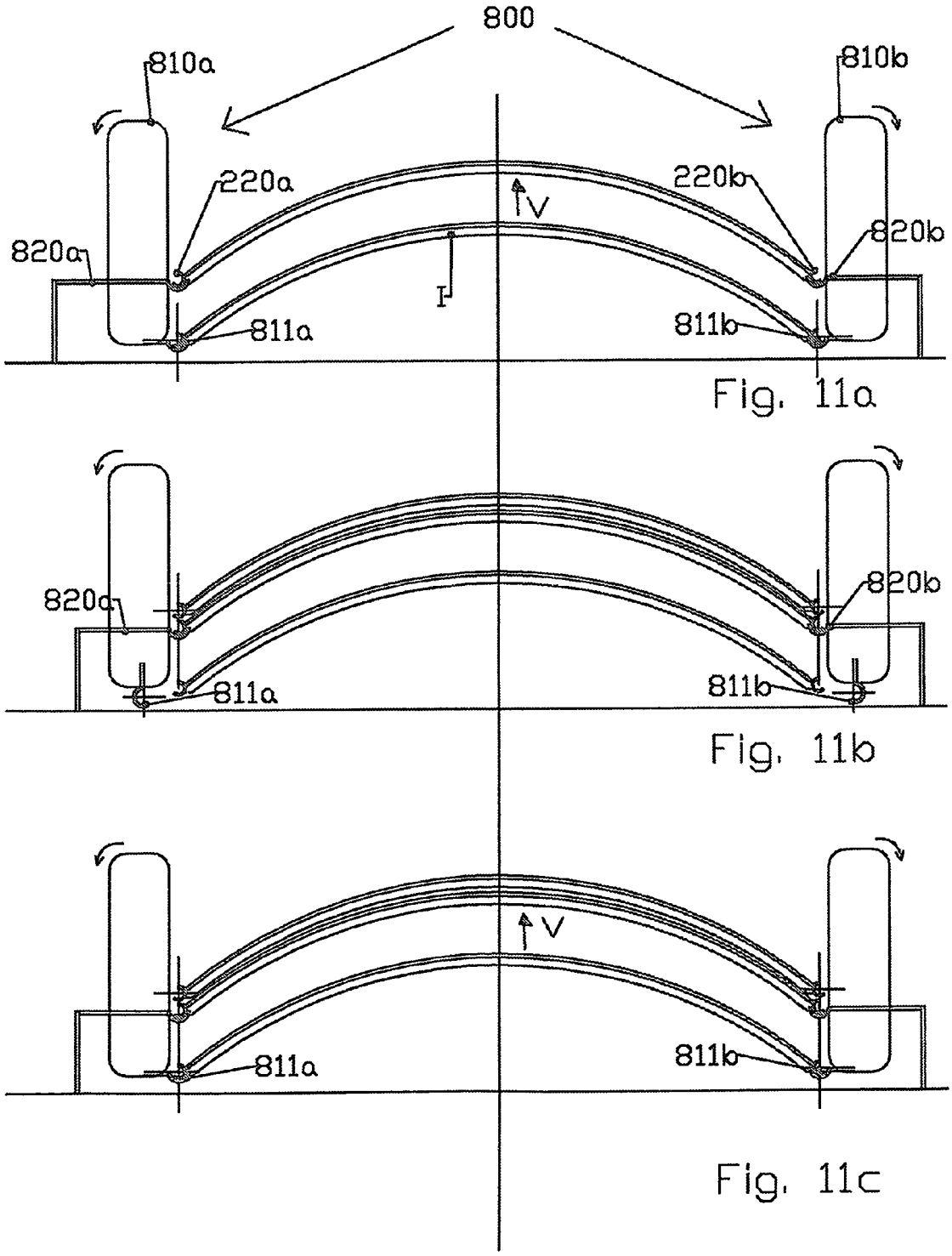
FIGS. 11*a*, 11*b*, 11*c* are diagrammatic drawings of a vertical partial cross-section view at the end of the roof showing a second embodiment of the stowing means.

According to another embodiment shown in FIGS. 11*a*, 11*b* and 11*c*, the two endless strips 810*a* and 810*b* are provided over their widths with gripping mechanisms 811*a* and 811*b* placed opposite each other for each endless strip 810*a* and 810*b* so as to engage simultaneously (as can be seen in the drawing in FIGS. 11*a*, 11*b* and 11*c*) with the two longitudinal parallel edges 220*a* and 220*b* of each roof component I which is presented between them in the storage area 600. Apart from the fact that they are not configured in a chain as for the first embodiment, these gripping mechanisms 811*a* and 811*b* are, according to an embodiment of the invention shown in more detail in the drawing in FIG. 7, embodied in hooks which are adapted to engage with corresponding fastening means 221*a* (for example hooks turned downwards) on the parallel longitudinal edges 220*a* and 220*b* of the roof components I through the rotation (arrow R) of the endless strips 810*a* and 810*b* which provide a vertical linear displacement (arrow V) of the hooks 811*a* and 811*b* associated with it over the rectilinear portion of said strips. Thus, by activating the displacement of the endless strips 810*a* and 810*b* in the direction of the arrow V, these are engaged with the lateral edges 220*a* and 220*b* of the roof component I, equipped to this end with said appropriate means of fastening to the hooks 811*a* and 811*b*, so as to lift them subsequently above the storage area 600, so that said roof component I comes to rest on fixed bearing surfaces 820*a* and 820*b* with the previous roof components which have been brought in the same way by the previous movements of the hooks and in such a way that they are stored in a stacked away on said bearing surfaces 820*a* and 820*b* above the storage area 600 as they are admitted to it.

The loosening or retraction of the bearing surfaces associated with a pitch movement which is the reverse of that of the arrow R of the endless strips 810*a* and 810*b* will ensure descent (reverse direction to that of the arrow V) for the purpose of discharging the roof components I from the storage area 600.

In this embodiment, an endless movement of the hooks is not necessary since a simple to and fro movement between the bearing surfaces 820*a* and 820*b* and the roof component pickup position is sufficient.

It is conceivable to equip the lower ends of the endless strips 810*a* and 810*b* with strip guide means not shown which, by giving an angle of inclination to said hooks will improve their fastening and/or their unfastening with the longitudinal edges 200*a* and 220*b* of the roof components I at the low points of the conveyors 810*a* and 810*b*.

According to another particularly advantageous characteristic of the invention and as shown in the drawings in FIGS. 12, 13*a*, 13*b*, 13*c* and 13*d*, the aforementioned stowing means 800 are constituted by a support frame acting as a framework for at least two elevators, of which only 830*a* is shown, which, placed in the storage area 600 on either side of the stack of stacked up roof components I, are able to grip and vertically displace (arrow V), in the storage area 600, each roof component I in an upward movement in order to store them stacked one on top of the other by feeding them one under the other and in a downward movement (the reverse of that of the arrow V) to lay them and place them on the longitudinal edges of the pool so as to juxtapose them one next to the other.

As shown, the elevator 830*a* is constituted by two cranks 831*a* and 832*a* the synchronised rotation of which ensures the vertical movement (arrow V) upwards of the single roof component I or of the already stacked roof components I. As shown, the cranks 831*a* and 832*a* engage with the roof component present at storage area level 600 so as to run it from a low position to a high position as shown in the drawings in FIGS. 13*a* and 13*b*. This transfer from a low position (cf. FIG. 13*a*) to a high position (cf. FIG. 13*b*) allows, through the action of the mobility means, the input of a new roof component I at the level of the elevation means (cf. FIG. 13*c*) which, by a rotary movement, deposit the raised up roof components onto the roof components placed beneath and engage to transfer the unit formed by the two stacked roof components I from a low position (cf. FIG. 13*d*) to a high position and so on until the input of the last roof component on which the others will rest. This process is reversed when the roof components are to return to cover the pool.

In order to facilitate the engagement of the cranks with the roof components I, the latter are equipped with two supports of each longitudinal edge. In this way, said cranks 831*a* and 832*a* engage with blocks forming cams associated with each roof component I.

Additionally, to facilitate storage in the stacked position, each roof component I is fitted with blocks inserted between each stacked up roof component. These blocks are preformed to receive the running support means of each roof component such as the running gear 710*a* with which they are fitted and to keep them in position.

According to one particularly advantageous characteristic, the blocks and supports are merged into one and the same part 240 equipping each longitudinal edge of the roof components I in pairs.

Particular care has been taken over this part 240 both in its block function since it is inserted between the roof components and in its function as a cam support followed by the crank of the elevation means.

Thus, according to a preferred characteristic, the upper part of said parts 240 is preformed in a concave shape 241 into which the running gear 710*a* is fitted. As a consequence, the parts 240 are not only inserted in height between the roof components but also position them longitudinally.

Figure 13A:
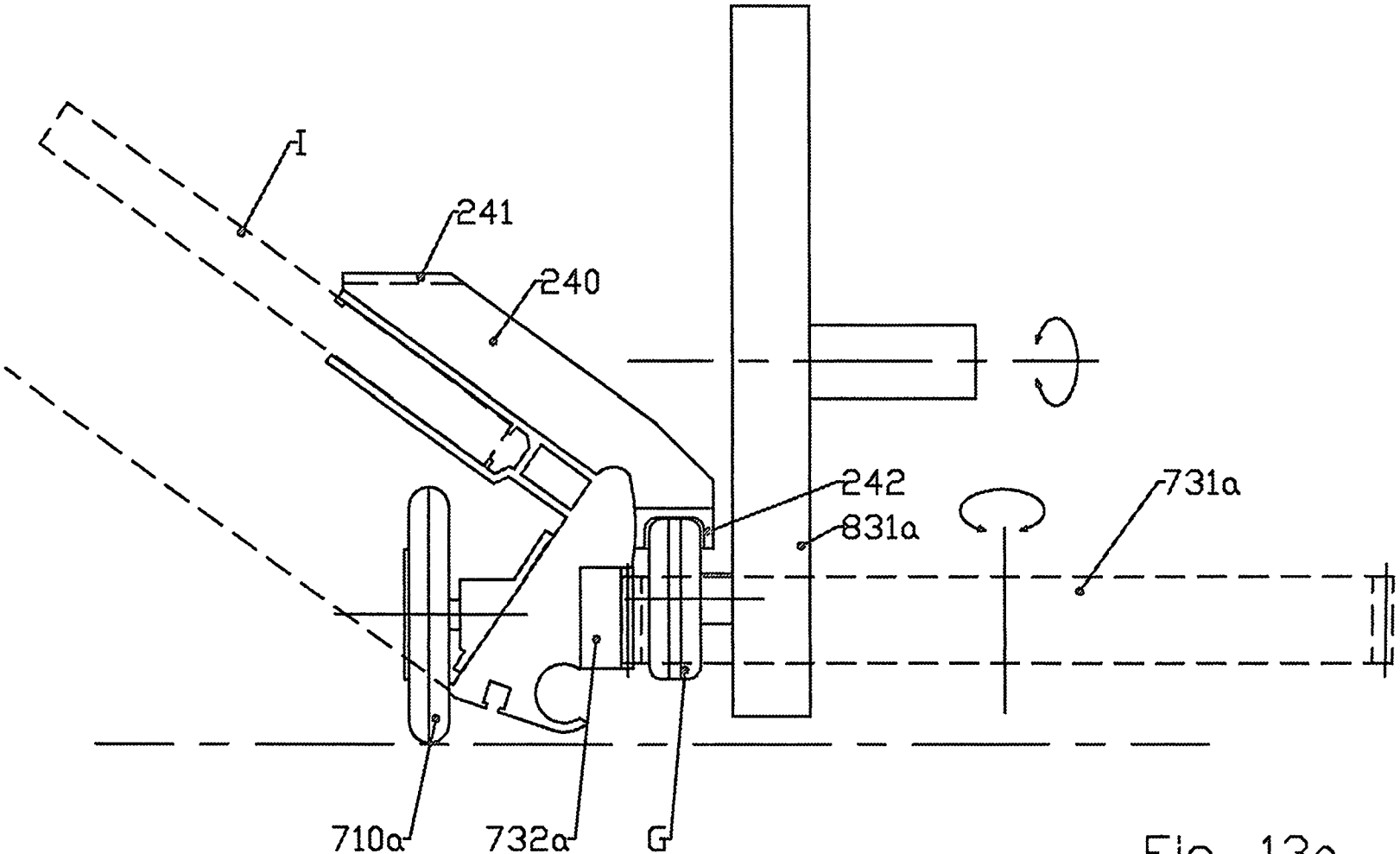
FIGS. 13*a*, 13*b*, 13*c*, 13*d* are diagrammatic drawings of a partial cross-section view showing the operation of the stowing means shown in FIG. 12.
Figure 13D:
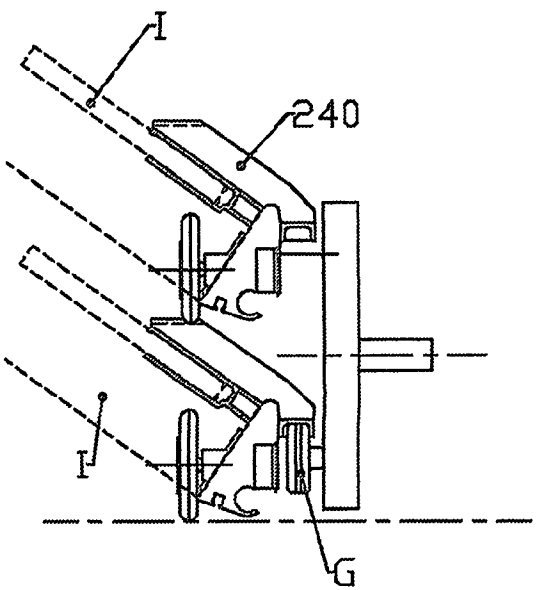
Figure 13C:
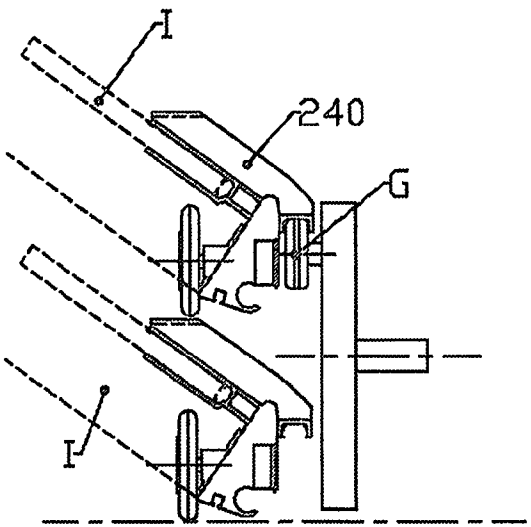
Figure 13B:
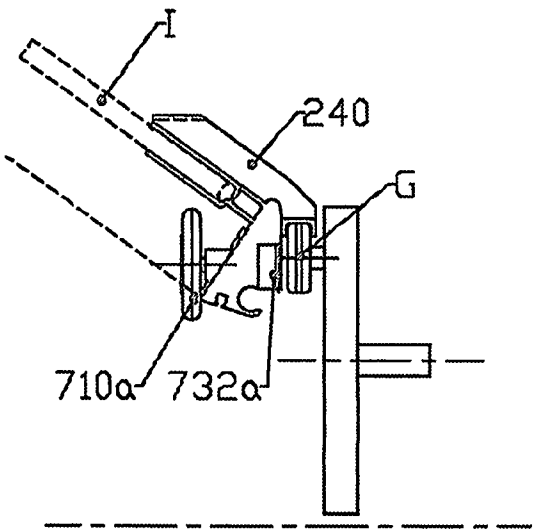

The drawing in FIG. 13*a* shows an embodiment in which the crank 831*a* is to advantage fitted with a roller G the displacement path of which 242 is preformed in the lower part of the parts 240. This preforming is such that the part 240 and in consequence the roof component associated with it are positioned laterally relative to said roller G. The elevation means being constituted by two pairs of cranks placed on either side of the storage area, the lateral positioning of the roof component during its storage is optimised by means of this characteristic.

Figure 12:
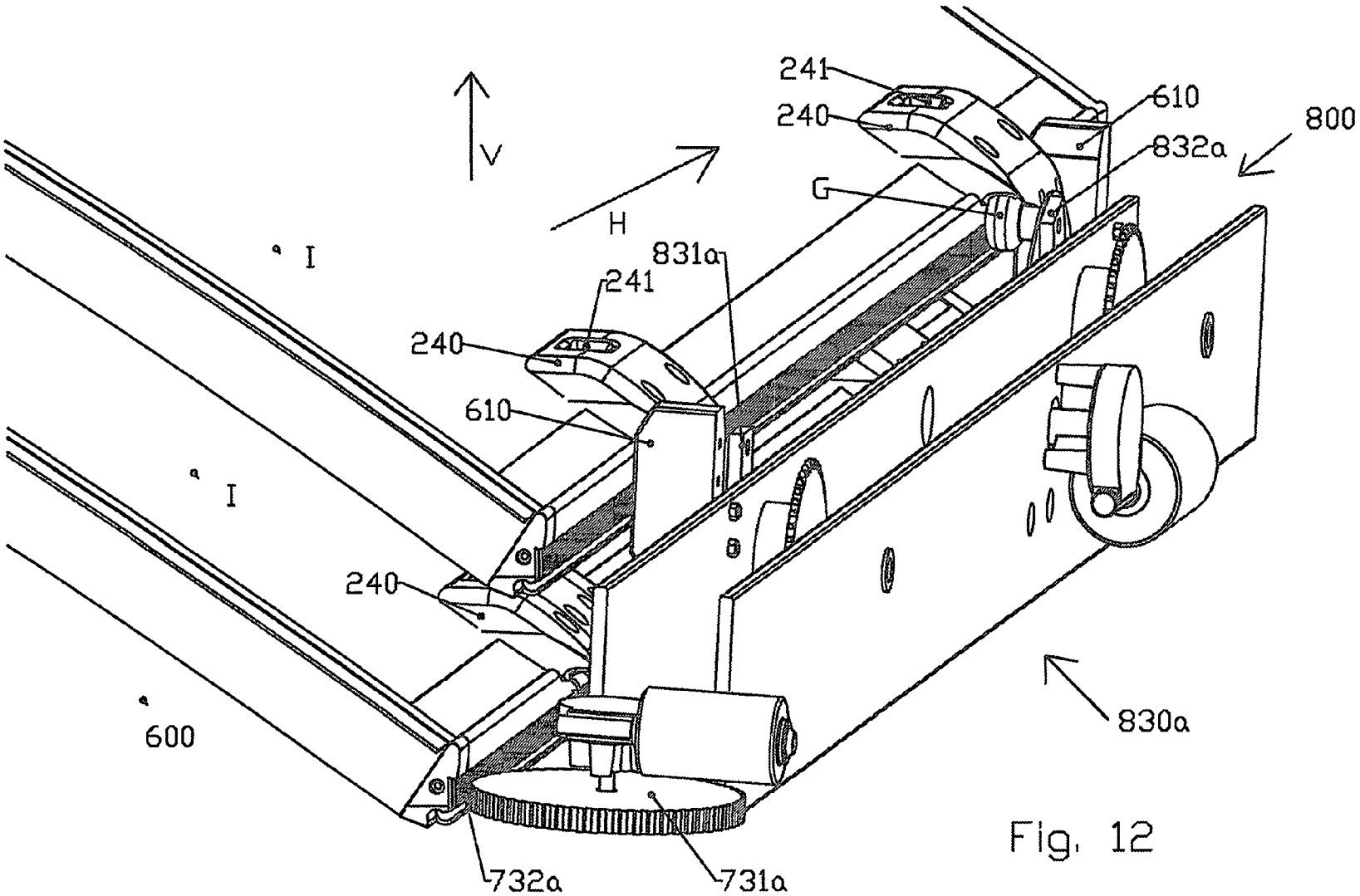
FIG. 12 is a detailed diagrammatic drawing of a partially exploded external perspective view of a stowing means solution and a mobility means solution.

Additionally, according to the embodiment of shown in the drawing in FIG. 12, the parts 240 are stopped on the mechanical stop units 610. The parts 240 therefore also contribute to the longitudinal positioning of the roof components in their movement.

According to another particularly advantageous characteristic and as shown in the FIGS. 14*a*, 14*b*, 14*c*, 15*a*, 15*b*, 15*c*, 15*d*, these stowing means 800 are constituted by two ramps 840*a* and 840*b* which, placed in the storage area 600 on either side of the stack of stacked up roof components I, are able to vertically displace (arrow V), in the storage area 600, each roof component I in an upward movement to store them stacked up one on top of the other by means of a displacement of said roof components on the ramps by feeding them one underneath the other and in a downward movement (the reverse of that of the arrow V) so as to juxtapose them one next to the other. These two ramps 840*a* and 840*b* engage with pins projecting externally from the roof components (I) so as to make said roof components effect an upward movement and tilt as shown in FIG. 15 such that the stored roof components form an open angle opposite those coming to be supported on their lower surface. According to a preferred embodiment, said pins coming to be supported on said ramps 840*a* and 840*b* are those 230*a* and 230*b* gripping said mobility means 740*a* and 740*b*.

Figures 15A, 15B, 15C, 15D:
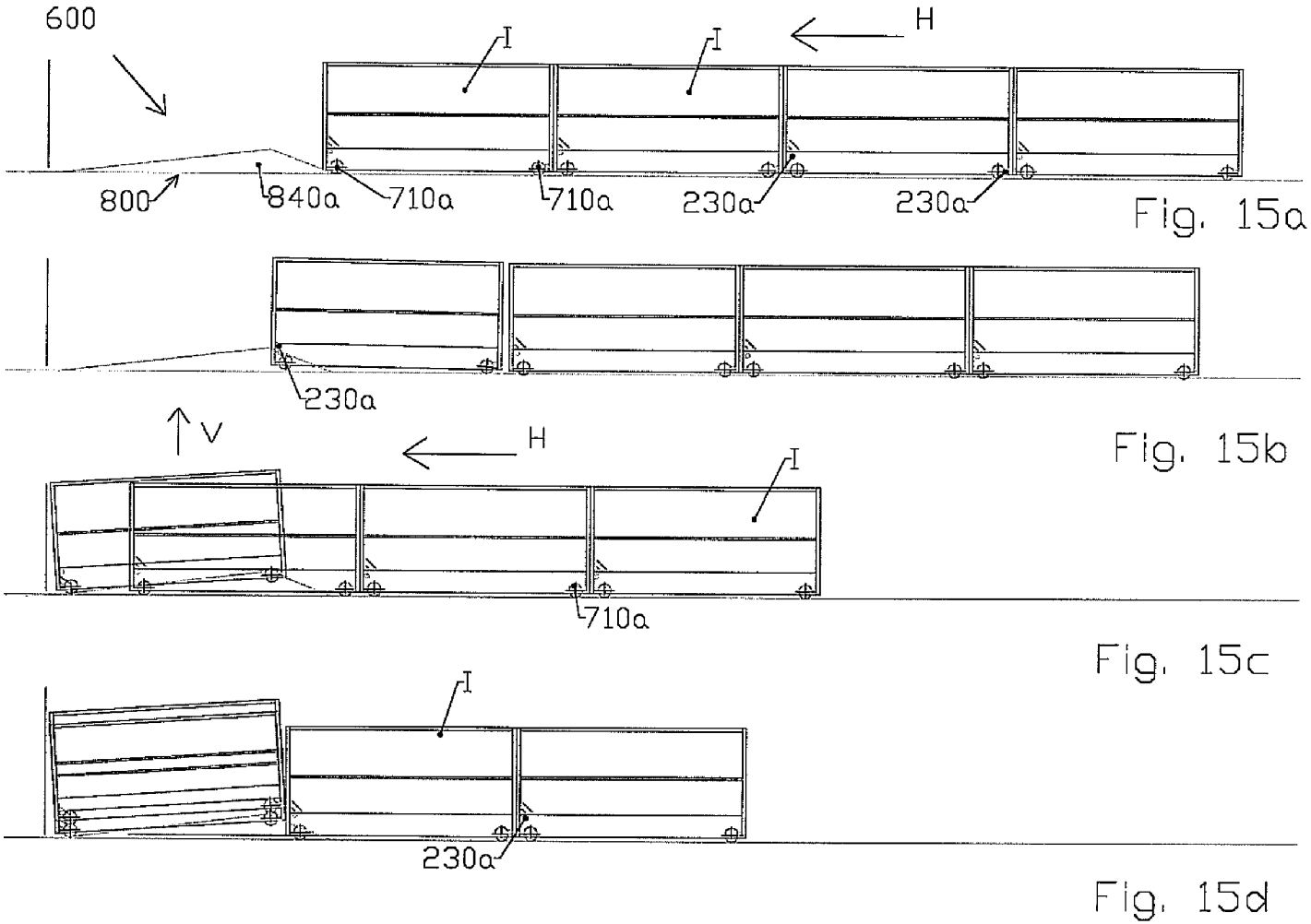
FIGS. 15*a*, 15*b*, 15*c* and 15*d* are diagrammatic drawings in a side view of a device in accordance with the invention showing the operation of the stowing means shown in FIGS. 14*a*, 14*b* and 14*c*.

According to this characteristic and as shown particularly in FIG. 15*c*, the translatory motion imparted to the roof components and the inclination that they adopt when they are in displacement on the ramp or when they are stored allow the upward displacement of the roof components.

With regard to the fourth means 900, i.e. the means of connecting the roof components I to each other, they have been provided indissociable on the one hand so as to secure them to each other to form the roof component train I able, under the effect of the motor-drive rollers 720*a* of the mobility means, to be displaced in a horizontal linear movement (arrow H) along said pool, and dissociable one from the other on the other hand, so that said roof components I on entering the storage area 600 are able, under the effect of the rotation (arrow R) of the endless conveyors 810*a* and 810*b* and the hooks 811*a* and 811*b* subjected to them, to be displaced in a vertical linear movement (arrow V) causing their disassociation and their superposition in the storage area 600. Thus, the connection means 900 are such that, when the roof components I evolve in a horizontal linear movement of thrust or pulling (arrow H), they are indissociable so as to keep the roof components secured to each other and to form a roof component train, and when a roof component I enters the storage area 600 (cf. FIG. 4) under the effect of the thrust of the roof component train I, they become dissociable to allow stacking by admission from underneath of the others of the roof components in the storage area 600.

As shown here, the connection means 900 of the roof components I are also dissociable from each other on the one hand, to allow the roof components I (arrow A in FIG. 2) to articulate freely relative to the support edge S of the pool and indissociable on the other hand, to push in the direction of the arrow H, but also to bring back in the direction reverse from that of arrow H, all the roof components I secured to each other such that the presence of the motor-drive rollers 720*a* at the input of the storage area 600 is enough to draw outwards from the pool (in the direction of the arrow H) or to push inwards towards the pool (in the direction reverse to that of the arrow H) all the roof components I so as to allow the exposed position or the concealed position of the pool respectively.

An electronic automatic control system for the motors driving the drive rollers 720*a* and the motor cylinders of the endless strips 810*a* and 810*b* which, as a function of cleverly fitted final position detectors and a programmed control activated by the user, allows the horizontal linear (arrow H) and vertical (arrow V) movements of the roof components I to be orchestrated according to an operational cycle which consists in alternating the horizontal (arrow H) and vertical (arrow V) displacement times of the roof components I and according to pitches corresponding, on the one hand, to the spacing pitch "p" of two hooks 811*a* and 811*b* of one and the same chain for the vertical displacement (arrow V) of the endless strips 810*a* and 810*b* and of the roof components I associated with them and on the other hand, to a pitch at least equal to the width of the roof components I for the horizontal displacement (arrow H) of said roof components I activated by the motor-drive rollers 720*a*.

When the connection means are dissociated, the roof components I of the roof fitted with the device of the invention can also offer the conventional advantages of the low profile cover of the roof T by allowing the half-open position through the articulation A of said roof components I (as shown in the drawing in FIG. 2) on the support edge S of the pool.

Figure 10B:
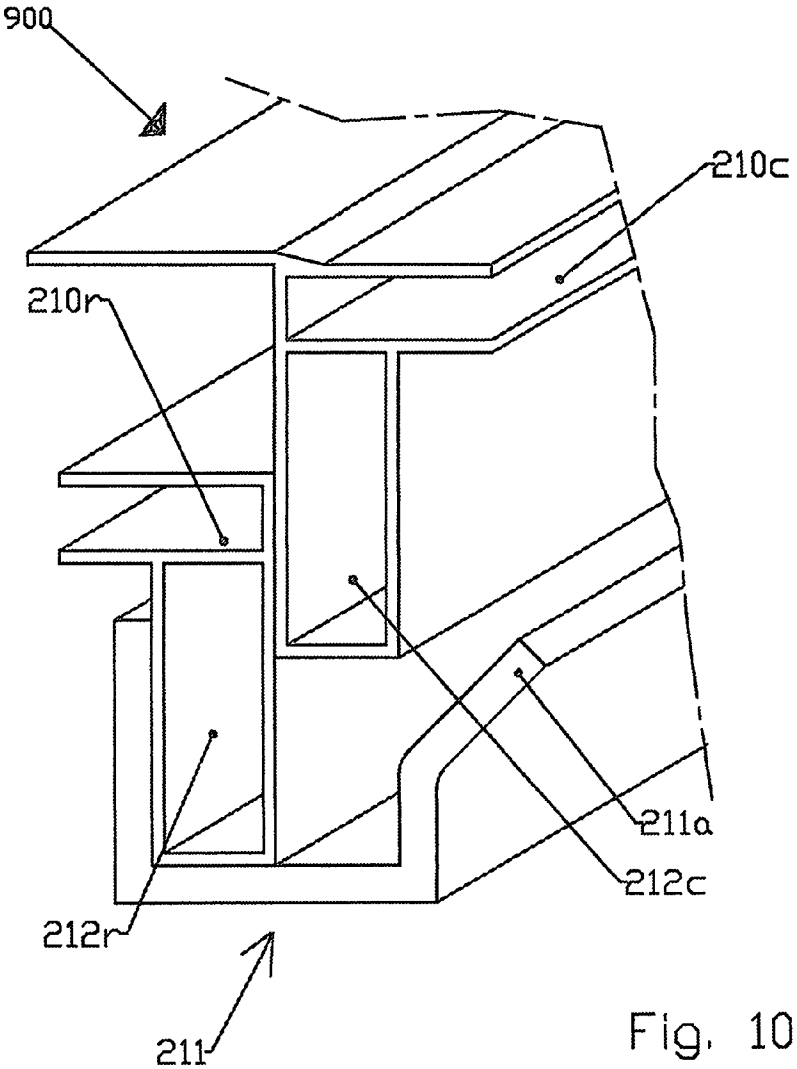
FIGS. 10*a* and 10*b* are partial perspective views of two contiguous arches of two swimming pool roof components shown respectively at one and the same level associated one with the other and at an offset level so as to be dissociated one from the other.
Figure 10A:
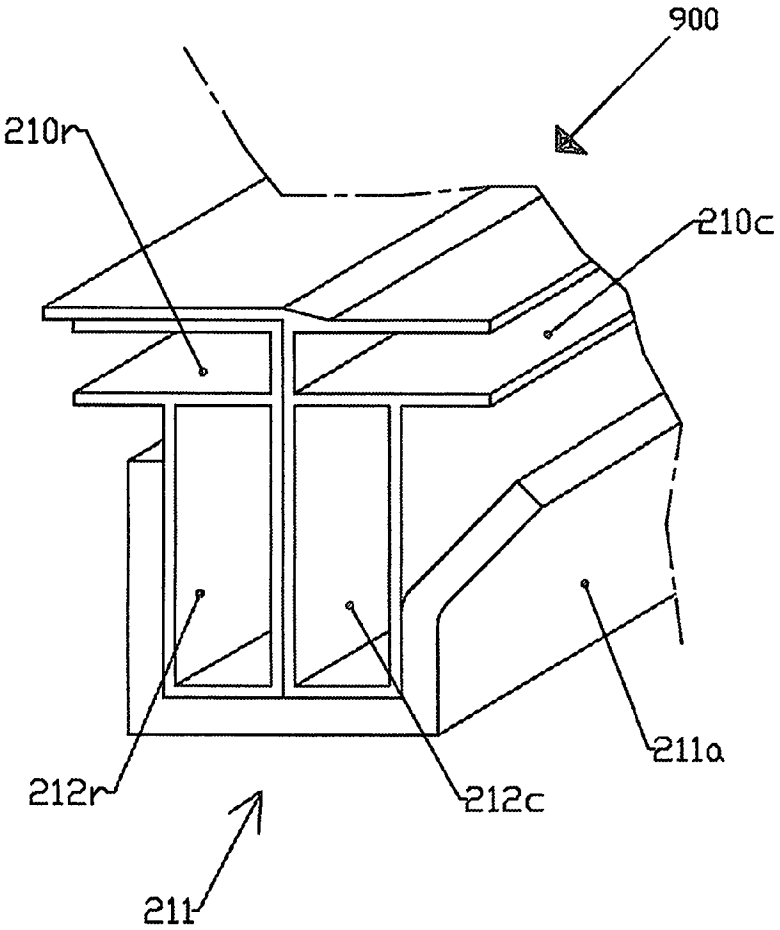

According to a first preferential embodiment of the invention, the aforementioned connection means are constituted by the wings of arches 210 which, placed to project in the extension of the cover panels 100 in translucent material to ensure the sealed partial covering of the juxtaposed roof components I of the roof T in the closed position, are fitted with a removable device for fastening to the arch 210 of the contiguous roof component I. Thus, as shown in more detail in the drawings in FIGS. 10*a* and 10*b*, each of the aforementioned connection means of two contiguous arches given the reference 210*r* for the covered roof component and 210*c* for the covering roof component conventionally comprising projecting wings is constituted by a U-shaped profile 211 which, intended to conform to the shape of the rectangular lower profiles 212*r* and 212*c* of said two contiguous arches, is fastened to the rectangular profile 212*r* of the arches 210*r* of the covered roof component such that the rectangular profile 212*c* of the arch 210*c* of the covering roof component can be housed and inserted in the U-shaped profile 211 (cf. FIG. 10*a*) during the movement of lowering by articulation (reverse direction from the arrow A in FIG. 2) or by descent in the storage area 600 (reverse direction from the arrow V in FIGS. 5 and 9) of the covering roof component in the lowered position and conversely disengage itself from said U-shaped profile 211 (cf. FIG. 10*b*) during the articulation movement in the direction of the arrow A of the same roof components to a half-open position or of the elevation movement in the direction of the arrow V to stack it in the storage area 600. Preferably, the upper part of the branch 211*a* of the aforementioned U-shaped profile 211 not integral with the arch 210*r* of the covered roof component is flared so as to facilitate the engagement with play of the rectangular lower profile 212*c* of the arch 210*c* of the covering roof component during its movement of lowering to a juxtaposed position. Likewise, the number and length of said connection means constituted by said U-shaped profiles are liable to vary.

It goes without saying that the device described and shown above may be fitted out in a number of adaptations while remaining in the context of the present invention, adaptations which consist for example:

- in adopting the same number of hooks 811*a* and 811*b* whatever the number of roof components I so as to standardise the manufacture of the conveyors 810*a* and 810*b*,
- in not restricting the number of motor-drive rollers 720*a* when the swimming pool components are of larger dimension,
- in providing guide rollers or counter guide rollers distributed over the length of the pool so as to guide the horizontal displacement (arrow H) of the roof components I, etc.

The invention claimed is:

1. A system for a swimming pool opening, the system comprising:

- a plurality of roof components, including a first roof component and a second roof component, each roof component including a cover, and a rigid frame including two arches, a first end crosspiece delimiting a first longitudinal edge-part configured to rest on a first longitudinal edge of the pool, and a second end crosspiece delimiting a second longitudinal edge-part configured to rest on a second longitudinal edge of the pool, the second longitudinal edge-part being parallel to the first longitudinal edge-part;
- a storage area located at an end of the pool the storage area being sufficient to accommodate a footprint of a roof component, allowing the roof components to be stored in a stacked way, all of the storage area being horizontally displaced from the pool opening, thereby exposing the swimming pool opening;
- a wheel configured to mobilize the roof components, allowing the roof components to be displaced horizontally in a linear movement direction along the pool towards and/or away from the storage area;
- a lifter in the storage area, the lifter being configured to engage the roof components to vertically displace the roof components, and place one roof component onto another roof component in a stacked position; and
- a convex member attached to a first roof component in the plurality of roof components and a concave member attached to a second roof component in the plurality of roof components, configured such that a vertical displacement of the concave member relative to the convex member acts to engage the first roof component with the second roof component, whereby the roof components can be juxtaposed such that the first longitudinal edge-part of the first roof component is on a first line parallel to the linear movement direction, the first longitudinal edge-part of the second roof component is on the first line parallel to the linear movement direction, the second longitudinal edge-part of the first roof component is on a second line parallel to the linear movement direction, and the second longitudinal edge-part of the second roof component is on the second line parallel to the linear movement direction, thereby covering the swimming pool opening.

2. A system according to claim 1, characterised in that the lifter comprises two conveyors which, placed inside the aforementioned storage means on either side of the stack of stored roof components, are able to grip and vertically displace inside the latter each roof component in an upward movement to store them stacked one on top of the other and in a downward movement to deposit them on the longitudinal edges of the pool in order to juxtapose them one next to the other.

3. A system according to claim 1, characterised in that the lifter comprises two ramps which, placed in the storage area on either side of the stack of stacked roof components, are able to vertically displace in the storage area each roof component in an upward movement to store them stacked one on top of the other by means of a displacement of said components on the ramps by feeding them one underneath the other and in a downward movement so as to juxtapose them one next to the other.

4. A system according to claim 3, characterised in that these two ramps engage with pins projecting externally from the roof components so as to make said components effect an upward movement and a tilt such that the stored roof components form an open angle opposite those coming to be supported on their lower surface by displacement imparted by said mobility means.

5. A system according to claim 1, characterised in that the aforementioned mobility means of said roof components allowing them to be displaced horizontally along the pool towards and/or away from said storage means are constituted:

- by running gear which, distributed over the width of the two parallel longitudinal edges of each roof component, ensures the free displacement of the edges along the edge, and therefore of the whole of the component associated with it,
- by a motor-drive roller which, placed at the input of the aforementioned storage means, is supported on the roof component present in front of them so as to run it in a direction outwards from the pool to make it completely enter the aforementioned storage means so as to disengage it from the pool which it was covering and to store it in the latter in a stacked way or, in the other direction inwards towards the pool, so as to discharge it from the storage area by pushing the other components which, in the form of a train of juxtaposed components, will gradually cover the pool opening.

6. A system according to claim 1, characterised in that the aforementioned mobility means of said roof components allowing them to be displaced horizontally along the pool towards and/or away from said storage means, include a horizontal drive endless strip which, placed at the input of the aforementioned storage means, engage with the roof component present in front of them so as to run it in a direction outwards from the pool to make it completely enter the aforementioned storage means so as to disengage it from the pool which it was covering and to store it in the latter in a stacked way or, in the other direction inwards towards the pool, so as to discharge it from the storage means by pushing the other components which, in the form of a train of juxtaposed components, will gradually cover the pool opening.

7. A system according to claim 1, further including a pinion being drawn into rotation by a fixed geared motor unit and the rack being integral with the longitudinal edge of the roof component.

8. A system according to claim 1, further including blocks inserted between each stacked roof component.

9. A system according to claim 1 wherein the arch of the covering component is fitted with a wing placed to project in the extension of the panels to provide the sealed partial covering of the arch of the juxtaposed covered component of the roof in the closed position, characterised in that each of the aforementioned connection means of two contiguous arches for the covered roof component and for the covering roof component of the roof components is constituted by a U-shaped profile which, intended to conform to the shape of the rectangular lower profiles of said two contiguous arches, is fastened to the rectangular profile of the arch of the covered component such that the rectangular profile of the arch of the covering component can be housed and inserted in the U-shaped profile during the movement of lowering the covering component into the closed position and conversely to disengage itself from said U-shaped profile during the movement of lifting the same component towards the open position.

10. A system according to claim 9 characterised in that the concave member is flared so as to facilitate the engagement with play of the concave member with the convex member.

11. A system according to claim 1 characterised in that the two conveyors of the aforementioned stowing means are each constituted by an endless strip drawn in rotation around two return cylinders in the upper and lower part of the conveyors of the aforementioned storage means and one of which is a drive cylinder to drive the endless strip around said cylinders.

12. A system according to claim 11 characterised in that the endless strips of the two conveyors of the aforementioned stowing means are provided over their width with a chain of gripping mechanisms placed opposite each other for each endless strip so as to engage simultaneously with the two longitudinal parallel edges of each roof component which is presented between them in the storage area.

13. A system according to claim 12 characterised in that the aforementioned gripping mechanisms are embodied in hooks which are evenly spaced out by a pitch "p" one from the other, and adapted so as to engage with corresponding fastening means on the longitudinal parallel edges of the roof components to allow the latter to be fastened or unfastened through the rotation of the endless strips which ensures a linear vertical displacement of the hooks associated with it over the rectilinear portion of said endless strips.

14. A system according to claim 5 characterised in that the aforementioned mobility means include two motor-drive rollers to ensure the horizontal displacements of the roof components by being supported on the two longitudinal edges of said roof components.

15. A system according to claim 14 characterised in that the axes of rotation of the aforementioned motor-drive rollers of the aforementioned mobility means are placed substantially inclined relative to the vertical and inwards towards the pool in such a way that the treads of said motor rollers are supported on the longitudinal edges of the roof components while guiding the horizontal displacement of said components.

16. A system according to claim 1 characterised in that it includes an electronic automatic control system for the motors driving the drive rollers and the motor cylinders of the endless strips which, as a function of final position detectors and a programmed control activated by the user, allows the horizontal linear and vertical displacements of the roof components to be orchestrated according to an operational cycle which comprises alternating the horizontal and vertical displacement times of the roof components and according to pitches corresponding:

for the vertical displacement of the endless strips and of the components associated with them, to the spacing pitch "p" of two hooks on one and the same chain, for the horizontal displacement of said components activated by the motor-drive rollers, to a pitch at least equal to the width of the roof components.

17. A system according to claim 1 wherein the lifter includes a conveyor.

18. A system according to claim 17 wherein the conveyor includes two endless strips.

19. A system according to claim 1 wherein the lifter includes a ramp.

20. A system according to claim 1 wherein the lifter is configured to vertically displace the roof components by revolving the roof components about a horizontal axis.

21. A system according to claim 1 wherein the wheel and the lifter are configured to cooperate so as to horizontally displace a first roof component into the storage area;

subsequently, vertically displace the first roof component in the storage area;

subsequently, horizontally displace a second roof component into a position under the first roof component in the storage area; and subsequently, place the first roof component onto the second roof component in the storage area.

22. A system according to claim 21 wherein the lifter is configured to vertically displace the first roof component by revolving the first roof component about a horizontal axis.

23. A system according to claim 1 wherein the wheel and the lifter are configured to cooperate so as to horizontally displace a first roof component into the storage area;

subsequently, vertically displace the first roof component in the storage area;

subsequently, horizontally displace a second roof component into a position under the first roof component in the storage area;

subsequently, place the first roof component onto the second roof component in the storage area; and subsequently, vertically displace a unit formed be the first and second roof components.

24. A system according to claim 23 wherein the lifter is configured to vertically displace the first roof component by revolving the first roof component about a horizontal axis.

* * * * *